US005410886A

United States Patent [19]

Wallace et al.

[11] Patent Number: 5,410,886

[45] Date of Patent: May 2, 1995

[54] METHOD AND APPARATUS FOR SUPPLEMENTING MECHANICAL REFRIGERATION BY THE CONTROLLED INTRODUCTION OF A CRYOGEN

[75] Inventors: David E. Wallace, Oregon, Wis.; Jeffrey P. Schulte, Somerset, N.J.

[73] Assignee: American Cryogas Industries, Inc., Pennsauken, N.J.

[21] Appl. No.: 987,217

[22] Filed: Dec. 8, 1992

[51] Int. Cl.[6] ..... F25D 13/06

[52] U.S. Cl. ..... 62/63; 62/332; 62/374; 62/381

[58] Field of Search ..... 62/332, 63, 374, 380, 62/381

[56] References Cited

U.S. PATENT DOCUMENTS

| | | | |
|---|---|---|---|
| 3,315,480 | 4/1967 | Rich | 62/63 |
| 3,507,128 | 4/1970 | Murphy et al. | 62/332 |
| 3,512,370 | 5/1970 | Murphy et al. | 62/64 |
| 3,531,946 | 10/1970 | Hart | 62/332 |
| 4,015,440 | 4/1977 | Pietrucha et al. | 62/166 |
| 4,060,400 | 11/1977 | Williams | 62/332 |
| 4,090,369 | 5/1978 | De Diouron | 62/63 |
| 4,116,017 | 9/1978 | Oberpriller | 62/51.2 |
| 4,127,008 | 11/1978 | Tyree, Jr. | 62/62 |
| 4,237,700 | 12/1980 | Rothchild | 62/51.2 |
| 4,244,193 | 1/1981 | Haakenson | 62/332 |
| 4,344,291 | 8/1982 | Tyree, Jr. et al. | 62/62 |
| 4,356,707 | 11/1982 | Tyree, Jr. et al. | 62/381 |
| 4,373,344 | 2/1983 | Hinn | 62/62 |
| 4,517,814 | 5/1985 | Rothstein | 62/374 |
| 4,739,623 | 4/1988 | Tyree, Jr. et al. | 62/63 |
| 4,813,245 | 3/1989 | Hubert et al. | 62/380 |
| 4,953,365 | 9/1990 | Lang et al. | 62/381 |
| 4,972,681 | 11/1990 | Lofkvist | 62/374 |
| 5,020,330 | 6/1991 | Rhoades et al. | 62/63 |
| 5,042,262 | 8/1991 | Gyger et al. | 62/64 |
| 5,237,695 | 8/1993 | Oberpriller | 62/332 |

FOREIGN PATENT DOCUMENTS

| | | |
|---|---|---|
| 12794/83 | 3/1982 | Australia . |
| 35305/84 | 11/1984 | Australia . |
| WO88/10072 | 12/1988 | WIPO . |

OTHER PUBLICATIONS

Mechanical Blast Freezer Enhancement System sales brochure, distributed by the Cardox Corporation, dated Jul. 17, 1991.

*Primary Examiner*—Ronald C. Capossela

*Attorney, Agent, or Firm*—Steven P. Shurtz; Willian Brinks Hofer Gilson & Lione

[57] ABSTRACT

A method and apparatus for increasing the refrigeration capacity a cooling operation that includes a mechanical refrigeration system is disclosed wherein the mechanical refrigeration system operates continuously and a cryogen is introduced into a mechanically refrigerated space only in the presence of heat load conditions that exceed the refrigeration capacity of the mechanical refrigeration system.

14 Claims, 7 Drawing Sheets

METHOD AND APPARATUS FOR SUPPLEMENTING MECHANICAL REFRIGERATION BY THE CONTROLLED INTRODUCTION OF A CRYOGEN

FIELD OF THE INVENTION

The present invention relates to the field of refrigeration, and more particularly to a method and apparatus for supplementing a mechanical refrigeration system by the controlled introduction of a cryogen directly into a refrigerated space in order to increase the refrigeration capacity of a cooling operation which includes a mechanical refrigeration system.

BACKGROUND OF THE INVENTION

Three basic techniques exist for removing heat from various substances to effect refrigeration and/or freezing: natural refrigeration, mechanical refrigeration and cryogenic freezing. In natural refrigeration, use is made of ice whereby the heat to melt the ice is extracted from the substance to be refrigerated. The limitation of this technique is the freezing point of water: hence natural freezing is of little practical value in modern mass-production freezing plants.

Mechanical refrigeration generally operates on the principle of a liquid-to-gas, gas-back-to-liquid cycle. Numerous methods and systems for providing mechanical refrigeration have been developed: vapor-compression, absorption, steam-jet or steam-ejector, and air. Each cycle operates between two pressure levels, and all except the air cycle use a two-phase working medium which alternates cyclically between the liquid and vapor phases.

The most common form of mechanical refrigeration incorporates the vapor-compression cycle. The vapor compression cycle consists of an evaporator in which a liquid refrigerant (such as ammonia or Freon) boils at low temperature to produce cooling, a compressor to raise the pressure and temperature of the gaseous refrigerant, a condenser in which the refrigerant discharges its heat to the environment, and an expansion valve through which the liquid expands from the high-pressure level in the condenser to the low-pressure level in the evaporator.

Vapor compression mechanical refrigeration systems are commonly used for the mass production of frozen foods. Foods having high water content, such as fish, tomatoes and citrus fruits, however, cannot be satisfactorily frozen with mechanical refrigeration systems since the relatively low freezing rates give rise to ice crystal growth, which ruptures the cell walls and tissues and causes food to assume a mushy consistency upon thawing. Slow freezing also causes a loss of moisture and of volatile oils, which impairs the flavor of the product and causes undesirable shrinking thereof.

In mass production freezing plants utilizing simple mechanical refrigeration systems such as the vapor-compression system described above, problems arise when the heat load inside the refrigerated space exceeds the refrigeration capacity of the mechanical refrigeration system. Mechanical refrigeration systems are inherently limited by the size and efficiency of the four basic components, reflected by the ability of the evaporator to absorb heat quickly. In mass-production freezing plants, the inability of a mechanical refrigeration system to absorb heat quickly causes production "bottlenecks," which result in decreased production rates and/or inadequately frozen products.

The third technique for removing heat from various substances to effect freezing involves the use of a cryogen. In cryogenic freezing, a cryogen, such as liquid carbon dioxide, liquid nitrogen, liquid air or any other substance having a normal boiling point below −100° F., is used to effect freezing by either direct or indirect contact with the material to be frozen. With cryogenic liquids, under carefully controlled conditions, freezing rates can be obtained which are so fast that high-water content products can be frozen in substantially amorphous form whereby little or no collapse of the internal structure will occur upon thawing. One important advantage of cryogenic freezing is that it reduces food shrinkage since the quick freezing of the water content limits the loss of moisture.

While cryogenic freezing may be effective with certain foods, for instance, where the food has a high water content and is of somewhat delicate internal structure, the change in internal temperature and the resultant formation of ice which expands the structure may give rise to thermal shock damage, as a consequence of which the product is cracked and otherwise mutilated.

Most mass production freezing plants in existence today incorporate mechanical refrigeration systems having limited refrigeration capacities. The existing mechanical refrigeration system is generally not capable of maintaining an optimal operating temperature if the heat load inside the refrigerated space exceeds the refrigeration capacity of the mechanical refrigeration system. In an attempt to accelerate the freezing action of an existing mechanical refrigeration system, i.e., increase its refrigeration capacity or the refrigeration capacity of the entire "cooling operation," additional mechanical refrigeration units could be added. This, however, would require the investment of substantial capital and may not prove cost-efficient. The lack of adequate factory space and problems with retrofitting existing mechanical systems may also prevent the addition of supplemental mechanical refrigeration units. Further, since most production facilities already have a substantial investment in their existing mechanical refrigeration units, replacing them with pure cryogenic systems would be timely and cost inefficient.

Arrangements have been proposed, such as that disclosed in U.S. Pat. No. 3,531,946, to combine a mechanical refrigeration system with a cryogenic system. In this "hybrid" cooling system, products are conveyed on a belt into a thermally-insulated chamber having fans which circulate cold air from mechanical refrigeration coils located below the conveyor belt. The products are sprayed with a cryogen after entering the chamber, the cryogen serving to superficially freeze the food to produce a thin ice glaze thereon, serving to prevent moisture loss from the food.

This cooling system, however, cannot function as designed due to inherently low internal operating temperatures caused by the operation of the cryogen system. The introduction of a cryogen having a temperature below −100° F. into a mechanically refrigerated space causes the temperature in the refrigerated space to drop significantly below the operating temperature of the mechanical refrigeration system, which, depending on the liquid refrigerant, is generally no lower than −40° F. Since there is no heat to be absorbed by the mechanical evaporator, the mechanical refrigeration system cannot function as designed and the mechanical refrigeration system shuts down.

Additional cooling systems which combine mechanical and cryogenic systems are also known. A two-stage freezing apparatus is disclosed in U.S. Pat. No. 4,517,814 in which a product is transported by a conveyor belt system through a liquid cryogen bed and thereafter to a conventional mechanical freezer. U.S. Pat. No. 4,972,681 discloses a freezing device in which products are first treated with a liquid cryogen, then moved via a conveyor system to a second area where fans are used to circulate the gaseous cryogen, and then moved to a third area which houses a conventional air freezer.

Although the concept of combining a mechanical refrigeration system and a cryogen system has been known in the art for some time, there still remains a need for a cooling operation or system which can increase the refrigeration capacity of a mechanical refrigeration system while not affecting the proper performance of the mechanical refrigeration system, thereby increasing the operating productivity rate in the presence of high heat load conditions, but which is relatively simple to install, which avoids the problems associated with retrofitting existing mechanical refrigeration systems, which does not require additional refrigerated or production space and which can operate simultaneously with a continuously operating mechanical refrigeration system.

SUMMARY OF THE INVENTION

In one aspect, the invention is a method of increasing the refrigeration capacity of a cooling operation that includes a mechanical refrigeration system by controllably introducing a cryogen into a refrigerated space cooled by the cooling operation while simultaneously operating the mechanical refrigeration system. In another aspect, the invention is a method for supplementing a mechanical refrigeration system comprising the steps of determining the presence of heat load conditions in a mechanically refrigerated space which exceed the refrigeration capacity of the mechanical refrigeration system and introducing a cryogen into the refrigerated space during periods in which heat load conditions exceed the refrigeration capacity of the mechanical refrigeration system while continuously operating the mechanical refrigeration system in order to maintain the temperature inside the refrigerated space within an optimal operating range, despite the presence of high heat load conditions.

In yet another aspect, the present invention is an apparatus for supplementing a mechanical refrigeration system comprising a cryogen system control adapted to detect the presence of heat load conditions which exceed the refrigeration capacity of the mechanical refrigeration system and to controllably introduce a cryogen into the refrigerated space.

DETAILED DESCRIPTION OF THE DRAWINGS AND PREFERRED EMBODIMENTS OF THE INVENTION

Figure 1:
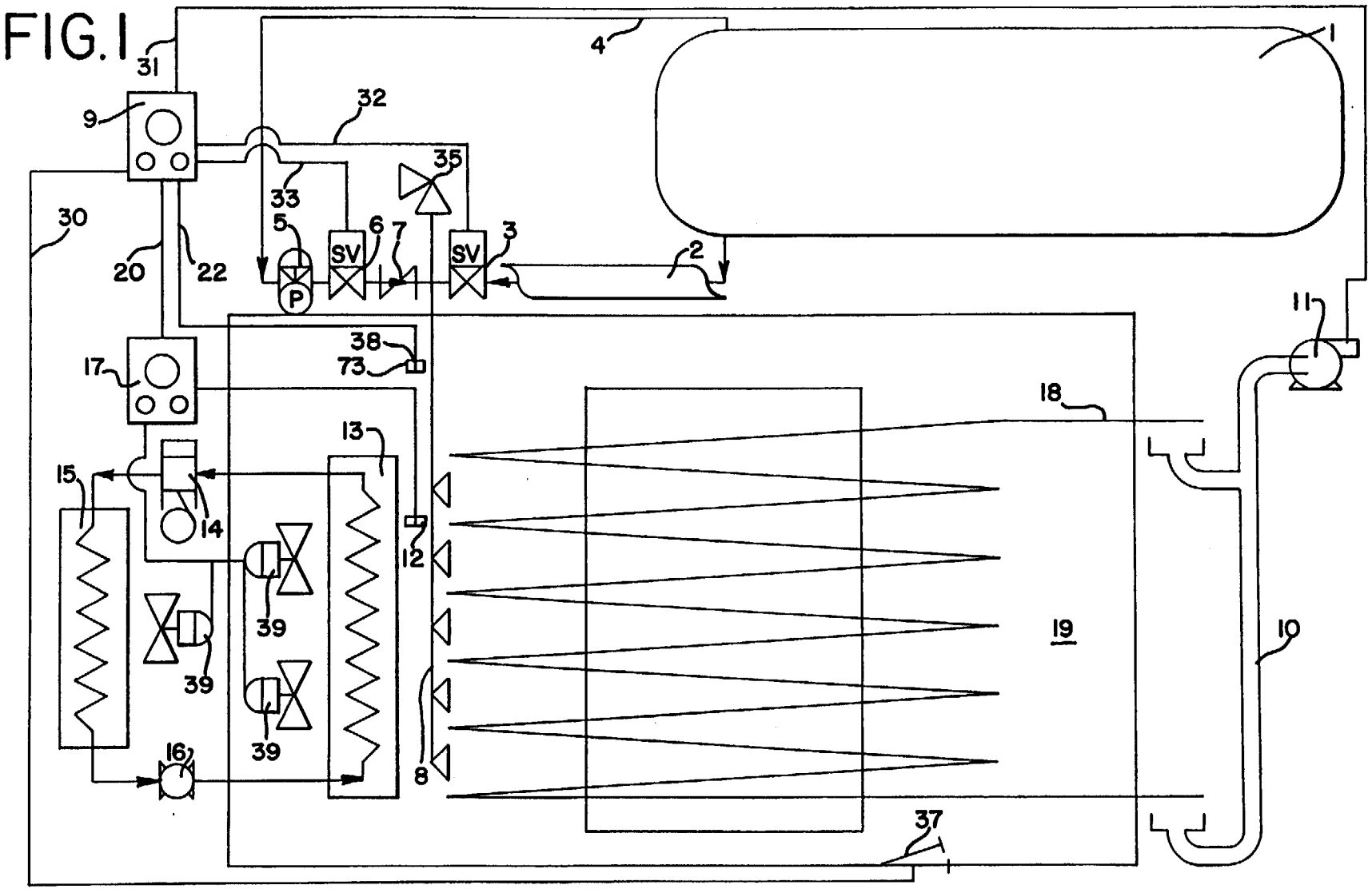
FIG. 1 is a diagrammatic view of a preferred embodiment of the supplemental cryogen system in combination with a mechanical refrigeration system wherein the cryogen system control receives input from both a mechanical refrigeration system control and an auxiliary thermocouple.

The supplemental cryogen system of the present invention increases the refrigeration capacity of a cooling operation that includes a mechanical refrigeration system by the controlled introduction of a cryogen into a refrigerated space cooled by the mechanical refrigeration system. The controlled introduction of a cryogen allows the mechanical refrigeration system to maintain an optimal operating temperature during periods when heat load conditions exceed the refrigeration capacity of the mechanical refrigeration system. Critical to the successful operation of the present invention is a cryogen system control which directly or indirectly monitors the temperature of the refrigerated space and coordinates the operation of the supplemental cryogen system with the mechanical refrigeration system such that the mechanical refrigeration system operates continuously and cryogen is introduced only as needed to attain and/or maintain an optimal operating temperature.

It is well known that conventional mechanical refrigerants generally have higher normal boiling points than do cryogenic materials. Ammonia (b.p. −28° F. at atmospheric pressure), for example, is a commonly used mechanical refrigerant which can cool a refrigerated space to approximately −40° F. If the temperature inside a mechanically refrigerated space drops below −40° F., there is no heat to be absorbed by the mechanical evaporator and the mechanical system would shut down until the temperature inside the refrigerated space rose to a temperature above −40° F. Likewise, the mechanical refrigeration system would continue to operate during periods when the temperature inside the refrigerated space remained above the operating temperature of the mechanical refrigerant, or in the example above, where the temperature is above −40° F.

If a cryogen were continuously introduced into a mechanically refrigerated space, as in the hybrid cooling system disclosed in U.S. Pat. No. 3,531,946, the internal operating temperature would drop well below −40° F. due to the presence of significant amounts of cryogen. As previously mentioned, such low operating temperatures would automatically cause most conventional mechanical refrigeration systems to shut down in order to prevent serious damage to the mechanical system compressor. In order to increase the refrigeration capacity of a mechanical refrigeration system, or to increase the refrigeration capacity of a cooling operation that includes a mechanical refrigeration system, and to prevent a mechanical refrigeration system from automatically shutting down, a cryogen system control, can be used. The cryogen system control is adapted to monitor the temperature of a refrigerated space and regulate the introduction of a cryogen into the mechanically refrigerated space. The mechanical refrigeration system thus operates continuously and, along with the supplemental cryogen system, functions to maintain an optimal operating temperature inside the refrigerated space despite the presence of high heat load conditions.

FIG. 1 illustrates the first preferred embodiment of the apparatus for supplementing a mechanical refrigeration system in accordance with the present invention. The supplemental cryogen system (also referred to as simply "a cryogen system") preferably includes a cryogen storage vessel 1, liquid cryogen piping 2, a liquid cryogen solenoid valve 3, a liquid cryogen spray nozzle header 8 and a cryogen system control 9.

The cryogen storage vessel 1 may be conveniently located outside an existing production facility or at a point far away from the refrigerated space 19. Preferably, storage vessel 1 is a Series CA or EA storage unit manufactured by Tomco Equipment Company located in Logan, Ga. Preinsulated Type K copper piping having ball type valves, manufactured by Rovanco Comapny located in Joliet, Ill., is preferably used for liquid cryogen piping 2 to transport liquid cryogen from the storage vessel 1 to the refrigerated space 19. A liquid cryogen solenoid valve 3 controls the flow of liquid cryogen into the refrigerated space 19. A suitable solenoid valve is Sporlan model No. MB14P2 with MKC-2 coils.

The liquid cryogen may be introduced into the refrigerated space 19 by any conventional liquid injection or introduction system. Liquid cryogen may be sprayed in a stream, for example, from a single nozzle, set of nozzles, manifold or series of manifolds. Preferably, nozzle header 8 comprises ⅜" diameter 304 stainless steel tubing with multiple drilled holes ranging from 0.040 to 0.125 inch in diameter. Although nozzle header 8 may be located anywhere in the refrigerated space 19, it is preferably located directly in front of the mechanical evaporator 13 with its spray being directed away from the evaporator (as shown in FIG. 1). Nozzle header 8 is also preferably located as far as possible from any openings in the refrigerated space 19, such as any inlet and outlet portions of a mechanical process conveyor 18. In this position, the low temperature of the cryogen spray least affects the temperature of the air surrounding the mechanical refrigeration system and the gaseous cryogen cannot easily escape the refrigerated space 19. In contrast to the prior art, the orientation of the nozzles may vary since the purpose of the cryogen spray is to cool the air in the refrigerated space 19, not to directly freeze a product. Direct spraying of the product, however, is also contemplated.

Figure 6:
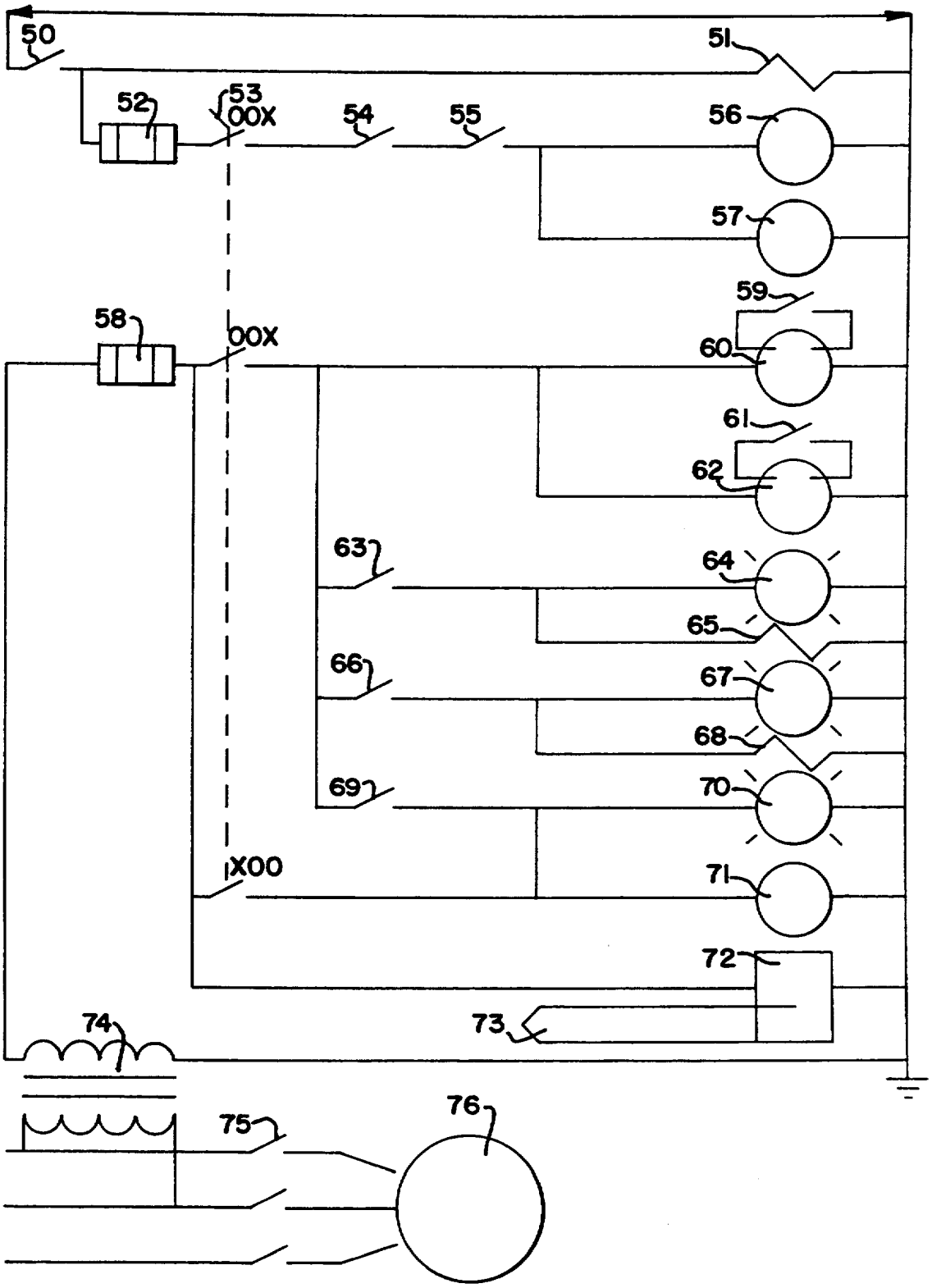
FIG. 6 is an electrical schematic of the cryogen system control of the preferred embodiment of the present invention as shown in FIG. 1.
Figure 7:
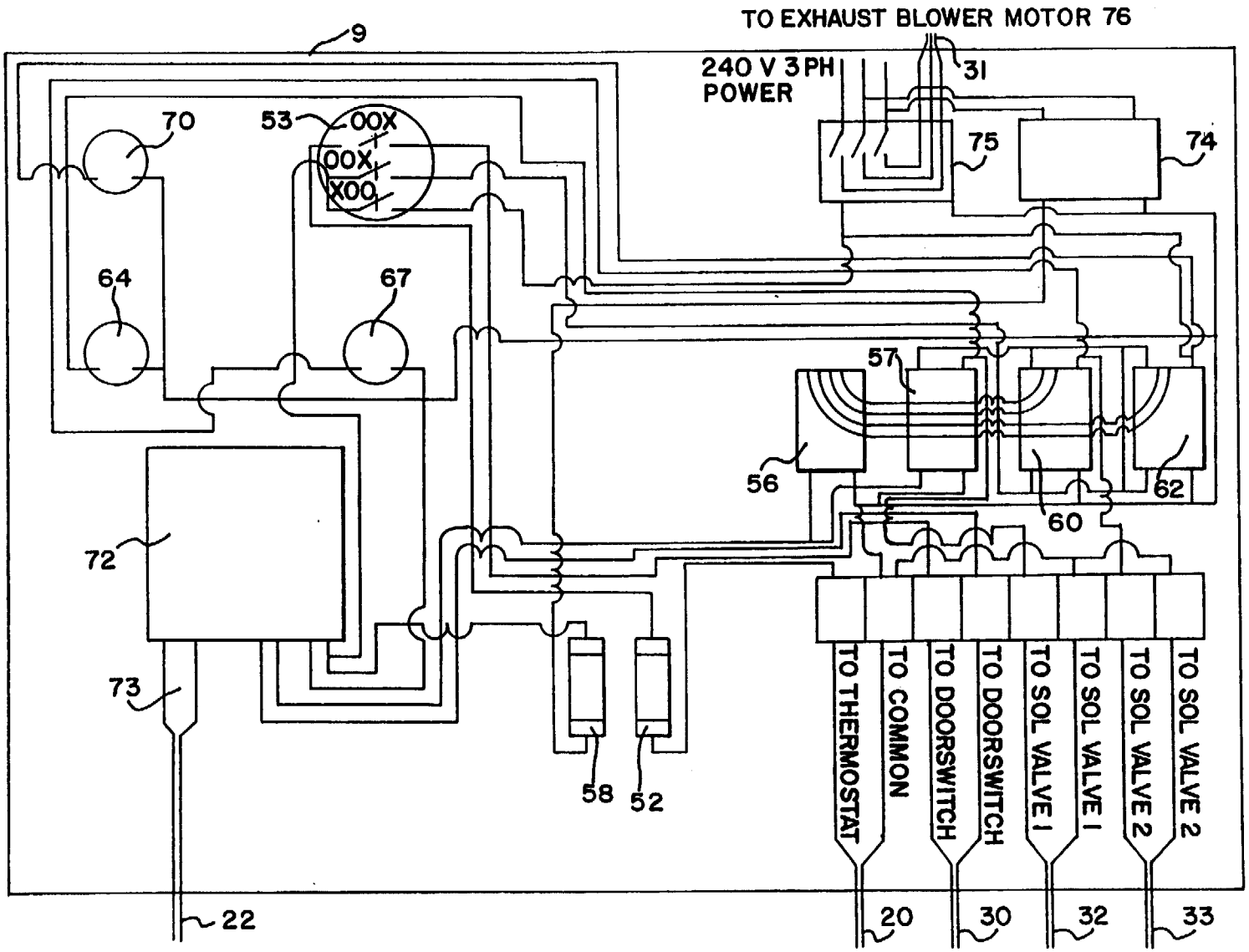
FIG. 7 is an electrical wiring diagram illustrating connections from the cryogen system control of the preferred embodiment of the present invention as shown in FIG. 1 to the supplemental cryogen system in combination with a mechanical refrigeration system.

The most critical component of the supplemental cryogen system is the cryogen system control 9. It is the function of the cryogen system control 9 to receive input from one or more sources regarding the heat load conditions inside the refrigerated space 19 and to activate or deactivate the supplemental cryogen system accordingly. Electrical schematics of the cryogen system control 9 of the first preferred embodiment of the present invention are shown in FIGS. 6 and 7, disclosed hereafter.

The cryogen system of the first preferred embodiment of the present invention incorporates a vapor purge system which prevents build-up of liquid cryogen, moisture or food particles in the cryogen system. The vapor purge system, as illustrated in FIG. 1, includes vapor cryogen piping 4 which originates from cryogen storage vessel 1. A vapor cryogen pressure regulator 5, preferably Norgren model No. 11-00-2177, and a vapor cryogen solenoid valve 6, preferably Sporlan model No. MB14P2 with MKC-2 coils, are used to regulate the pressure and flow of the cryogen vapor. A pressure gauge (not shown) may also be incorporated into the vapor purge system. A vapor cryogen check valve 7, preferably Nupro ½ in. model No. SS-8C2-1 (1 PSID), is incorporated into the vapor cryogen piping 4 at a point beyond the vapor solenoid valve 6. A relief valve 35 may also be incorporated into the liquid cryogen piping 2 at a point beyond the check valve 7.

As shown in FIG. 1, the vapor purge system joins the liquid cryogen piping at a point after the liquid solenoid valve 3. In this manner, when the liquid cryogen solenoid valve 3 cuts off the flow of liquid cryogen to the refrigerated space 19, the vapor purge system can flush the remaining liquid cryogen piping 2 and spray nozzle header 8.

In order to properly vent the refrigerated space 19, cryogen exhaust pick-up and ducting 10 is preferably installed directly outside the refrigerated space 19. An exhaust blower motor 11, preferably Dayton model No. 3NO43H, and a radial wheel blower, preferably Dayton model 4C217, may be used to prevent build-up of cryogen vapor inside the refrigerated space 19.

Also shown in FIG. 1 is a typical vapor-compression mechanical refrigeration system comprising an evaporator 13, a compressor 14, a condenser 15, an expansion valve 16 and several fans 39. The operation of the mechanical refrigeration system is controlled by a mechanical system control 17 which is connected to a temperature measuring device or thermocouple 12 located inside the refrigerated space 19. Typically, the mechanical system control 17 monitors the temperature of the refrigerated space 19 via the mechanical system thermocouple 12 located near the evaporator 13 and controls the operation of the mechanical refrigeration system based on the internal operating temperature and the desired "set point" temperature of the mechanical refrigeration system.

In the first preferred embodiment of the present invention, the cryogen system control 9 is connected to and receives input from both the mechanical system control 17 via connection 20 and auxiliary thermocouple 38 via connection 22. The cryogen system control 9 can be programmed to activate and deactivate the supplemental cryogen system at certain preset temperatures or set points. Thus, when the thermocouple 38 or thermocouple 12 (via connection 20 to mechanical system control 17) detects a temperature above an upper predetermined set point temperature, the cryogen system control 9 activates the cryogen system to introduce cryogen into the refrigerated space 19. The cryogen is introduced into the refrigerated space 19 until either thermocouple indicates a temperature below the lower predetermined set point, at which time the cryogen system control 9 deactivates or shuts down the cryogen system. This cycle is repeated in order to maintain the temperature of the refrigerated space 19 as close as possible to the optimal operating temperature of the mechanical refrigeration system.

The optimal operating temperature of the mechanical refrigeration system is generally the lowest temperature the mechanical refrigeration system can attain while operating at normal heat load conditions. The optimal operating temperature thus depends on the liquid refrigerant used in the mechanical refrigeration system. For example, in mechanical refrigeration systems using ammonia as the mechanical refrigerant, a mechanical refrigeration system can generally only attain temperatures of −35° to −40° F. Similarly, in systems using Freon 502, the mechanical refrigeration system can reach temperatures of −40° F. It is thus the purpose of the supplemental cryogen system of the present invention to maintain the optimal operating temperature of a mechanical refrigeration system when the system is subjected to variable or high heat load conditions.

In the first preferred embodiment of the present invention, the cryogen is introduced into the mechanically refrigerated space 19 only for as long as necessary to attain and/or maintain a temperature inside the refrigerated space that is within the optimal operating temperature range, as determined by the upper and lower set point temperatures. By utilizing the cryogen system control 9 to controllably introduce a cryogen, the temperature inside the refrigerated space 19 can be kept relatively constant despite the presence of high heat load conditions.

In use, when cryogen system control 9 of the first preferred embodiment detects (via mechanical system control 17 and mechanical thermocouple 12 or via auxiliary thermocouple 38) a temperature inside the refrigerated space 19 that is above a predetermined optimal operating temperature range or set point (such as −40° F. in the example above), the cryogen system control 9 activates the cryogen system. Upon activation of the cryogen system, the exhaust blower and the vapor cryogen purge systems operate immediately.

In the vapor purge system, cryogen vapor from the storage vessel 1 fills the vapor piping 4 between the storage vessel 1 and the vapor solenoid valve 6. A cryogen vapor pressure regulator 5 adjusts the pressure of the cryogen vapor in the piping. When using liquid carbon dioxide, for example, the pressure of the vapor is preferably approximately 100 PSI. Upon activation of the cryogen system, the vapor cryogen solenoid valve 6 is opened to allow the cryogen vapor to flow through. When opened, the vapor passes through a vapor cryogen check valve 7, then through a portion of the liquid cryogen piping 2 and out through spray nozzle header 8. The vapor purge system is used to flush the liquid piping 2 and nozzle header 8 of any excess liquid cryogen, moisture, food particles or other debris that could potentially clog any portion of the liquid cryogen system.

After a vapor purge period time delay of generally one to three minutes, the liquid cryogen solenoid valve 3 is opened, causing liquid cryogen to flow through the liquid cryogen piping 4 to the cryogen spray nozzle header 8. The direct injection of liquid cryogen causes the temperature of the refrigerated space 19 to decrease. When the temperature inside the refrigerated space 19 falls below the lower set point or lower limit of the optimal operating temperature range, the liquid solenoid valve 3 stops the flow of liquid cryogen to the refrigerated space 19. Following a vapor purge time delay period necessary to flush the system of liquid cryogen and debris, the vapor cryogen purge and exhaust systems shut off. The vapor purge and exhaust systems may shut off simultaneously, or the vapor system may shut off before the exhaust system so that excess gaseous cryogen does not build up in the refrigerated space 19.

The supplemental cryogen system remains off until heat load conditions in excess of the refrigeration capacity of the mechanical refrigeration system are again present. High heat load conditions are present when the temperature inside the refrigerated space rises above the upper limit of the optimal operating temperature range or set point, while the mechanical refrigeration system is operating. It is also contemplated that the presence of high heat load conditions may be detected by conditions other than temperature, such as conditions affecting the proper performance of the mechanical system, which are discussed later.

The supplemental cryogen system may be designed such that conditions in addition to high heat load (generally indicated by temperature) must be present before operation of the supplemental cryogen system is possible. For example, the cryogen system control 9 of the first preferred embodiment is programmed such that the cryogen system can only be activated if the mechanical refrigeration system is operating. Another condition which must be satisfied prior to operation of the supplemental cryogen system is that any door, such as door 37, allowing entry into a refrigerated space 19 (especially in the case of walk-in freezers) be closed or that a door safety switch be in a "closed" position. Other conditions which must be satisfied prior to the activation of the supplemental cryogen system, in addition to those described herein, are also contemplated.

The electrical schematics shown in FIGS. 6 and 7 illustrate the wiring of cryogen system control 9 of the first preferred embodiment of the present invention as shown in FIG. 1. The cryogen system control 9 is preferably fitted with a three position selector switch 53. In addition to providing a primary "on/off" control for the supplemental cryogen system, the three position selector allows the operator to choose an "exhaust only" setting, indicated by "xoo" in FIGS. 6 and 7. This setting is useful for flushing the refrigerated space 19 of excess gaseous cryogen independently of the operation of the cryogen system.

When the selector switch 53 is in the "on" or "auto" position, as shown by the designation "oox," three contacts must close before the supplemental cryogen system will operate: the mechanical system thermostat contact 50, the refrigerated space temperature contact 55 and the access door contact 54. The closing of the mechanical system thermostat contact 50 indicates that the mechanical refrigeration system is operating. Likewise, the closing of the refrigerated space temperature contact 55 indicates that the temperature inside the refrigerated space 19 is above the upper set point limit. A temperature controller 72, preferably Watlow model No. 956, controls the closing of the temperature contact 55. Lastly, the closing of the access door contact 54 indicates that any doors, such as door 37 in FIG. 1 allowing entry into the refrigerated space 19, are closed.

The desired operating temperature of the refrigerated space 19 is manually entered into the temperature controller 72 via a set point adjustment. This set point adjustment thus defines the optimal operating temperature range. "Off delay" periods for both the vapor purge and exhaust portions of the supplemental cryogen system are also entered manually prior to activation of the supplemental cryogen system.

When all the above listed conditions have been satisfied and the respective contacts closed, control relay 56 and "on delay" relay 57 are energized. The energizing of control relay 56 causes contacts 59 and 61 to close. The closing of contacts 59 and 61 energize the "off delay" control relay timers for the vapor purge and exhaust systems respectively. The function of these timers is to keep the controlled equipment operating for a manually preset amount of time after the respective contacts are opened. Thus, the vapor purge and exhaust blower systems will continue to function, for a preset period once control relay 56 is deenergized.

The closing of contact 59 energizes "off delay" relay 60, which closes contact 66. The vapor purge portion of the supplemental cryogen system is thereafter immediately activated: vapor solenoid 68 is energized, causing vapor solenoid valve 6 (FIG. 1) to open and vapor cryogen indicator light 67 is energized, thereby indicating the vapor purge system is operating.

Likewise, the closing of contact 61 energizes "off delay" relay 62, which closes contact 69. The exhaust portion of the supplemental cryogen system is thereafter immediately activated: motor starter coil 71 is energized causing exhaust blower motor 76 to operate and an exhaust indicator light 70 is energized, indicating the exhaust system is operating. Specifically, the energizing of blower motor starter 71 closes the three motor contacts 75, thereby allowing exhaust blower motor 76 to operate by applying three phase power at 240 or 480 volts. Transformer leads on two of the three motor contacts 75 supply control power, generally single phase at 120 volts, to the cryogen system control 9 by step-down transformer 74.

The energizing of "on delay" relay 57 closes contact 63 after a preset "on delay" period of time. When contact 63 closes, liquid solenoid 65 is energized, thereby opening liquid solenoid valve 3 (FIG. 1) and allowing the liquid cryogen portion of the cryogen system to operate. A liquid cryogen system indicator light 64 is also energized upon the closing of contact 63, thereby showing that the liquid cryogen system is operating.

Thus, upon activation of the supplemental cryogen system, the vapor purge and exhaust portions operate immediately. The liquid cryogen solenoid valve 3 opens after a predetermined "on delay" period to introduce liquid cryogen into the refrigerated space 19. Both the vapor purge and exhaust portions remain operating while the liquid cryogen is introduced into the refrigerated space 19. The vapor purge flow, however, stops at check valve 7 once the liquid cryogen is flowing past the check valve 7, due to the pressure differential between the gaseous and liquid cryogen.

The introduction of liquid cryogen into the refrigerated space 19 causes the internal operating temperature of the refrigerated space 19 to decrease significantly. When the internal operating temperature reaches the lower set point as manually entered into the temperature controller 72, temperature contact 55 opens, causing a loss of power to the supplemental cryogen system and in particular, to control relay 56 and "on delay" relay 57. When "on delay" relay 57 deenergizes or loses power, it opens contact 63. The opening of contact 63 immediately deenergizes liquid solenoid 65 which closes liquid solenoid valve 3 (as shown in FIG. 1), thereby stopping the flow of liquid cryogen into the refrigerated space 19. Liquid cryogen indicator light 64 also turns off.

Due to the "off delays," the vapor purge and exhaust portions of the supplemental cryogen system continue to function for a predetermined period of time after control relay 56 is deenergized. Specifically, the deenergizing of control relay 56 causes contacts 59 and 61 to open. The opening of contact 59 deenergizes "off delay" relay 60, which opens contact 66 after a predetermined "off delay" period of time. Similarly, the opening of contact 61 deenergizes "off delay" relay 62, which opens-contact 69 after a predetermined "off delay" period of time. The visible effect of these "off delays" is to shut down both the vapor purge and exhaust systems a preset period of time after the liquid cryogen system shuts off.

The operation described above repeats when the temperature of the refrigerated space 19 rises to a temperature above the upper set point temperature, as manually entered into the temperature controller 72. Thus, temperature controller 72 is preprogrammed to close temperature contact 55 at the upper set point temperature (indicating a need for liquid cryogen to lower the internal operating temperature) and to open temperature contact 55 at the lower set point temperature (indicating that the liquid cryogen system should be shut off due to a low internal operating temperature). Temperature probe 73 is connected to cryogen system control 9 via connection 22.

FIG. 7 illustrates the actual physical wiring of cryogen system control 9 and in particular, illustrates the various connections to and from cryogen system control 9 to the supplemental cryogen system as shown in FIG. 1.

The supplemental cryogen system of the present invention may be used in any conventional refrigeration or freezer apparatus, including but not limited to continuous feed or in-line freezers, walk-in refrigerator systems, process or spiral freezers, etc.

Although any conventional cryogen or material having a normal boiling point below −100° F. may be used, liquid carbon dioxide (b.p. −109.5° F. at atmospheric pressure) is preferred. The cryogen is preferably injected as a liquid. Carbon dioxide, for example, exists as a liquid under pressure and can be injected as a liquid which thereafter forms a mixture of solid or "snow" and gas.

Figure 2:
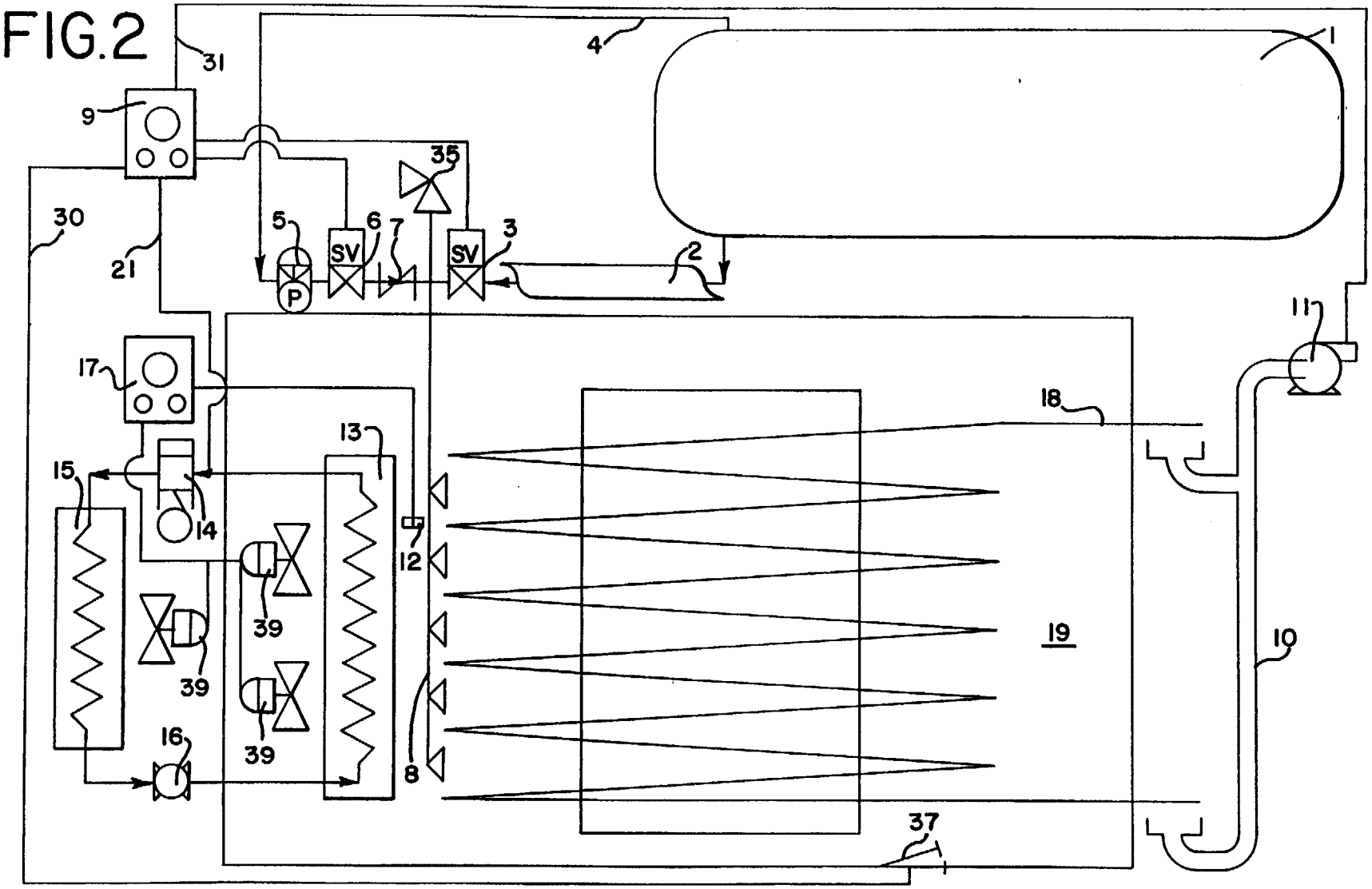
FIG. 2 is a diagrammatic view of a preferred embodiment of the supplemental cryogen system in combination with a mechanical refrigeration system wherein the cryogen system control receives input from a mechanical refrigeration system compressor.

Additional preferred embodiments of the apparatus of the present invention are shown in FIGS. 2, 3, 4 and 5 which are the same as the embodiment of FIG. 1 (and hence the same reference numbers are used in all figures) except that the cryogen system control 9 is connected to various other components, as illustrated by single connections 21, 22, 23 and 20 respectively. FIG. 2 illustrates a preferred embodiment of the present invention in which the cryogen system control 9 connects to and monitors compressor 14 of the mechanical refrigeration system. This connection, illustrated by number 21, allows the cryogen system control 9 to receive input regarding the temperature and/or pressure of the refrigerant gas entering the compressor 14. When temperature and/or pressure of the gas in the compressor falls within a range indicating high heat load conditions in the refrigerated space 19, the cryogen system control 9 activatestimal operating temperature range without affecting the proper performance of the mechanical refrigeration system.

Figure 3:
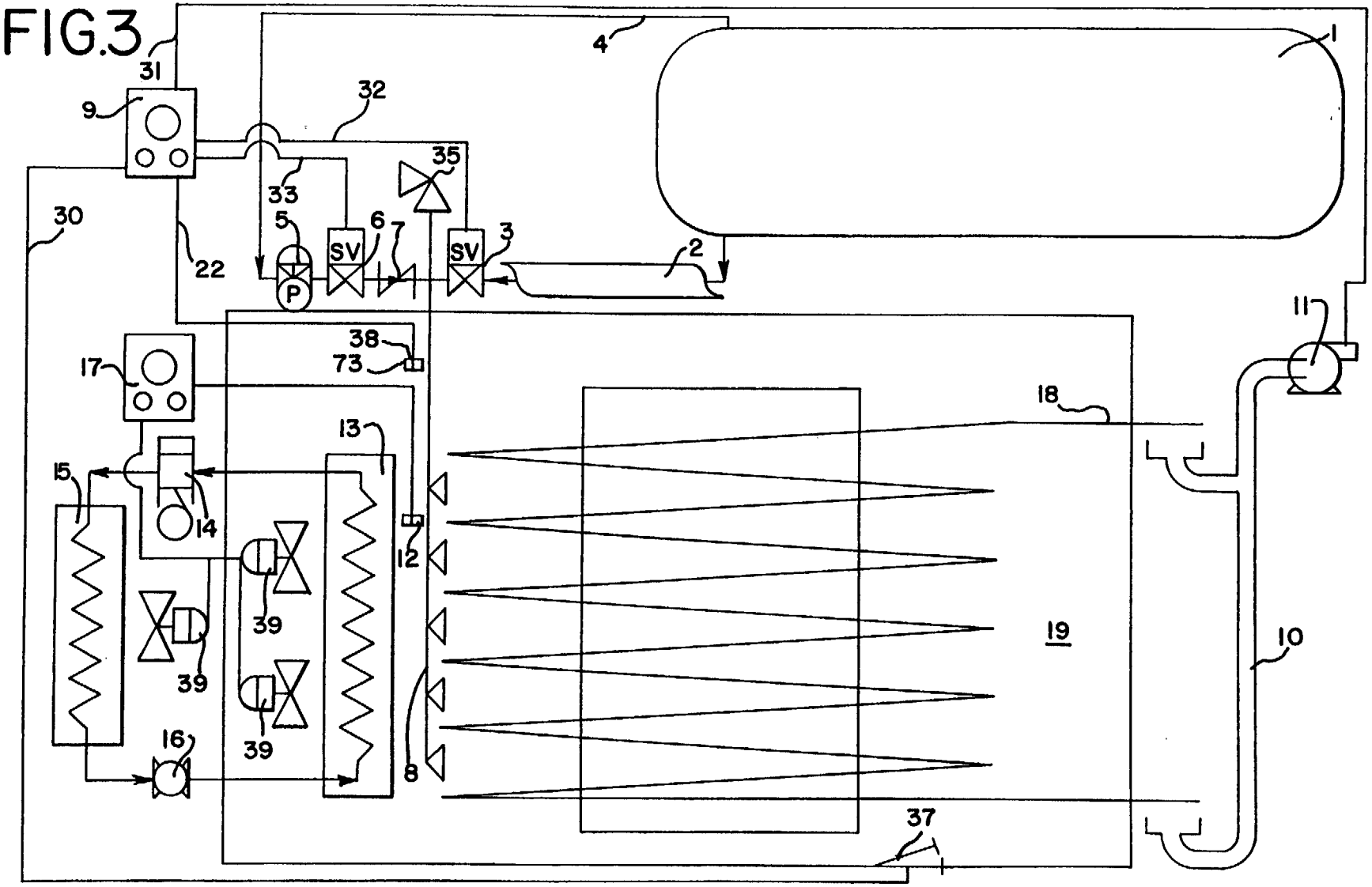
FIG. 3 is a diagrammatic view of a preferred embodiment of the supplemental cryogen system in combination with a mechanical refrigeration system wherein the cryogen system control receives input from an auxiliary thermocouple located inside the refrigerated space.

FIG. 3 illustrates another preferred embodiment of the present invention. In this embodiment, the cryogen system control 9 is only connected to auxiliary thermocouple 38 located inside the refrigerated space 19, as shown by connection 22. When the temperature inside the refrigerated space 19, as measured by auxiliary thermocouple 38, exceeds the upper limit of the predetermined optimal operating temperature range or set point, the cryogen control system 9 activates the cryogen system in accordance with the previously described procedure.

Figure 4:
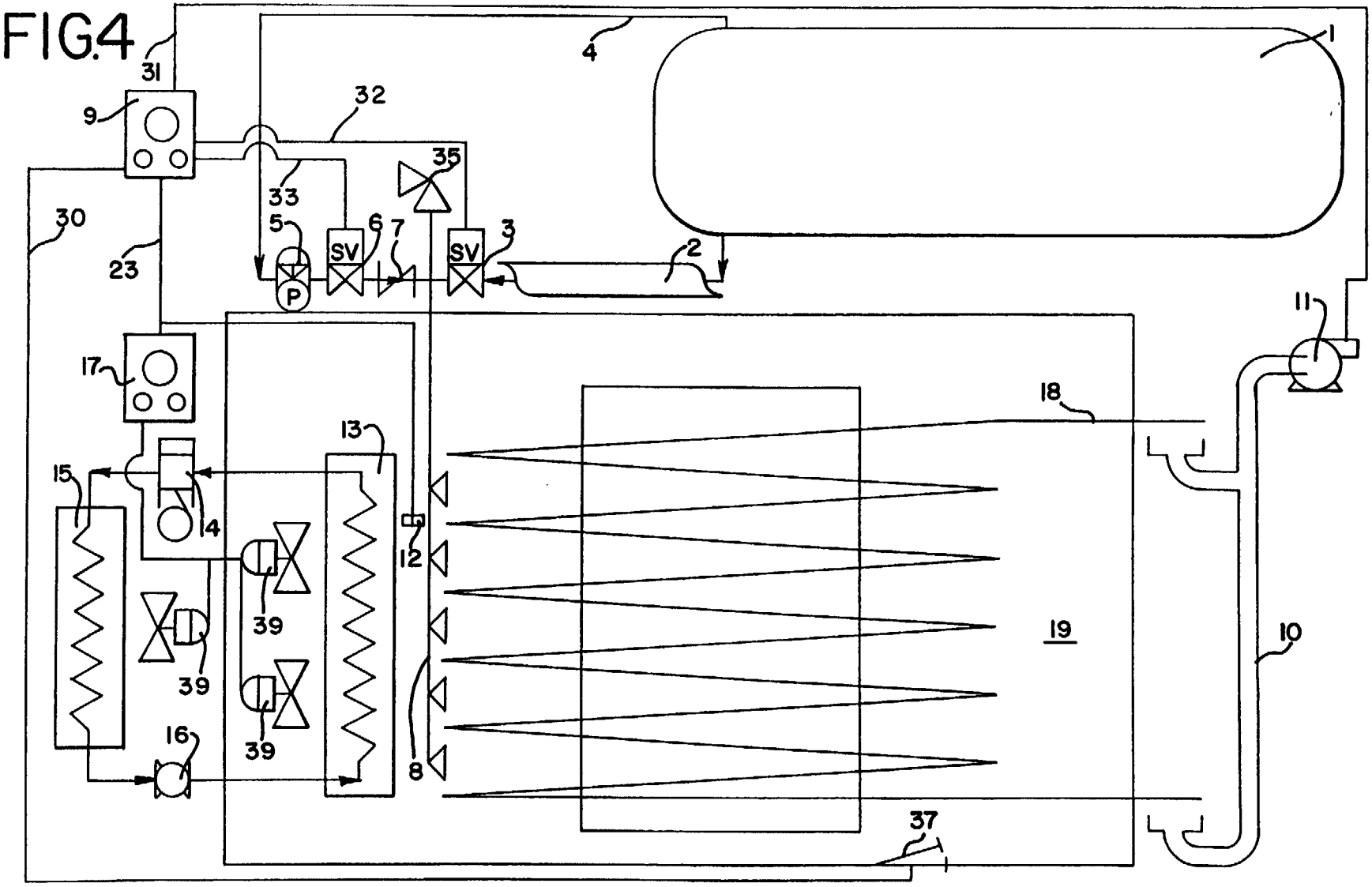
FIG. 4 is a diagrammatic view of a preferred embodiment of the supplemental cryogen system in combination with a mechanical refrigeration system wherein the cryogen system control receives input from a mechanical refrigeration system thermocouple.

FIG. 4 illustrates another preferred embodiment of the present invention wherein the cryogen system control 9 utilizes input directly from the mechanical thermocouple 12 as illustrated by connection 23. In this manner, the cryogen system control 9 detects the presence of heat load conditions in excess of refrigeration capacity of the mechanical system by using the same thermocouple 12 the mechanical system control uses to monitor the internal operating temperature.

Figure 5:
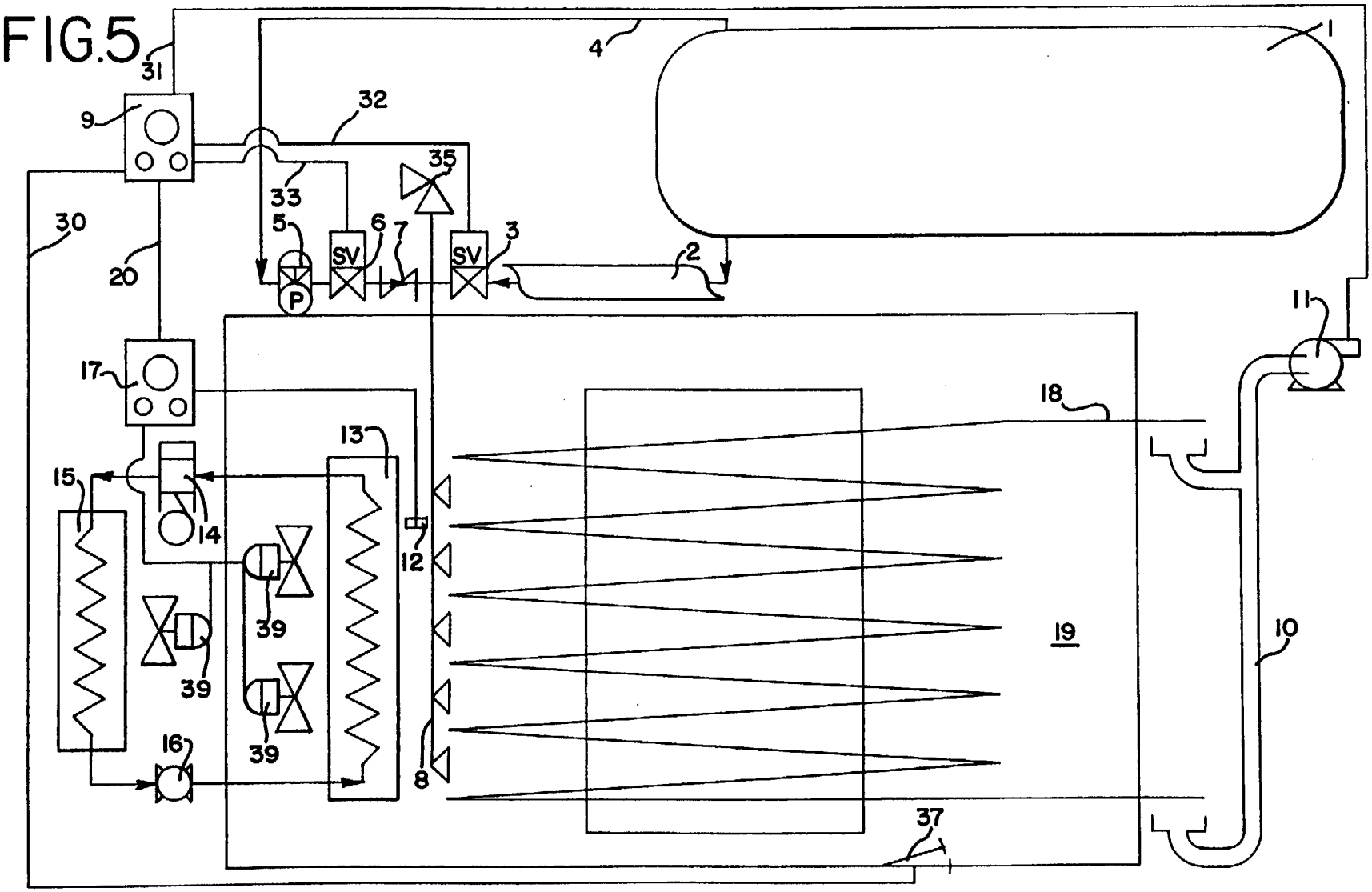
FIG. 5 is a diagrammatic view of a preferred embodiment of the supplemental cryogen system in combination with a mechanical refrigeration system wherein the cryogen system control receives input from a mechanical system control.

Lastly, FIG. 5 illustrates a preferred embodiment of the present invention wherein the cryogen system control 9 utilizes input from the mechanical system control 17 to detect the presence of heat load conditions inside the refrigerated space 19 in excess of the refrigeration capacity of the mechanical refrigeration system.

The electrical schematics of the cryogen system control 9 of the embodiments shown in FIGS. 2, 3, 4 and 5 would be similar to that shown in FIG. 6, except for single connections 21, 22, 23 and 20 respectively. The schematics would obviously differ according to these connections and their respective sources, but the respective control systems 9 for these and other embodiments would be similarly represented.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by all the appended claims rather than by the foregoing description. All changes which come within the meaning and range of equivalency of the claims are to be embraced within their scope.

We claim:

1. A method of increasing the refrigeration capacity of a mechanical refrigeration system in a continuous production spiral food freezer comprising the steps of:
   (a) determining the presence of heat load conditions in a refrigerated space which exceed the refrigeration capacity of the mechanical refrigeration system used to cool the refrigerated space; and
   (b) introducing a cryogen into the mechanically refrigerated space during periods in which the heat load conditions inside the refrigerated space exceed the refrigeration capacity of the mechanical refrigeration system, the introduction of the cryogen being controlled by a cryogen system control adapted to coordinate the introduction of the cryogen with the continuous operation of the mechanical refrigeration system.

2. The method of claim 1 wherein the cryogen system control receives input from a mechanical refrigeration system compressor in order to detect the presence of heat load conditions which exceed the refrigeration capacity of the mechanical refrigeration system.

3. The method of claim 1 wherein the cryogen system control receives input from a mechanical refrigeration system control in order to detect the presence of heat load conditions which exceed the refrigeration capacity of the mechanical refrigeration system.

4. The method of claim 1 wherein the cryogen system control receives input from an auxiliary temperature sensor located within the refrigerated space in order to detect the presence of heat load conditions which exceed the refrigeration capacity of the mechanical refrigeration system.

5. The method of claim 1 wherein the cryogen system control receives input from a temperature sensor used to control the mechanical refrigeration system in order to detect the presence of heat load conditions which exceed the refrigeration capacity of the mechanical refrigeration system.

6. The method of claim 1 wherein the cryogen system control receives input from one or more sources which monitor the presence of heat load conditions which exceed the refrigeration capacity of the mechanical refrigeration system.

7. A method for increasing the production rate of a continuous production spiral food freezing system which includes a mechanical refrigeration system comprising the steps of:
   (a) determining the presence of heat load conditions in a refrigerated space that exceed the refrigeration capacity of the mechanical refrigeration system,
   (b) introducing a cryogen into the refrigerated space during periods in which heat load conditions exceed the refrigeration capacity of the mechanical refrigeration system while continuously operating the mechanical refrigeration system.

8. An apparatus for increasing the refrigeration capacity of a continuous production spiral food freezer that includes a mechanical refrigeration system comprising a cryogen system control adapted to controllably introduce a cryogen into a refrigerated space cooled by the mechanical refrigeration system such that the cryogen is introduced into the refrigerated space only in the presence of heat load conditions which exceed the refrigeration capacity of the mechanical refrigeration system.

9. The apparatus of claim 8 further comprising
   (a) a cryogen storage vessel connected to
   (b) a cryogen introduction system via
   (c) cryogen piping, the piping having incorporated therein
   (d) a cryogen solenoid valve adapted to control the flow of liquid cryogen therethrough.

10. The apparatus of claim 9 comprising a vapor cryogen purge system further comprising:
   (a) vapor cryogen piping originating from a cryogen storage vessel and having incorporated therein
   (b) a vapor cryogen pressure regulator,
   (c) a vapor cryogen solenoid valve, and
   (d) a vapor cryogen check valve.

11. The apparatus of claim 10 further comprising at least one exhaust blower and exhaust ducting for the escape of gaseous cryogen from the refrigerated space.

12. An apparatus for increasing the production rate of a continuous production spiral food freezer which includes a mechanical refrigeration system comprising a cryogen system control adapted to controllably introduce a cryogen into a refrigerated space such that the cryogen is introduced into the refrigerated space only in the presence of heat load conditions which exceed the refrigeration capacity of the mechanical refrigeration system.

13. A method of increasing the refrigeration capacity of a continuous production spiral food freezer that includes a mechanical refrigeration system comprising the steps of controllably introducing a cryogen into a refrigerated space cooled by the mechanical refrigeration system while continuously operating the mechanical refrigeration system wherein the cryogen is introduced into the refrigerated space during periods in which heat load conditions inside the refrigerated space exceed the refrigeration capacity of the mechanical refrigeration system.

14. The method of claim 13 wherein the cryogen is introduced by being sprayed into the atmosphere of the mechanically refrigerated space in a manner that causes it to dissipate into the mechanically refrigerated atmosphere and not to directly contact a product to be refrigerated.

* * * * *